United States Patent [19]

Mitchell, Jr.

[11] 4,444,117

[45] Apr. 24, 1984

[54] STACKED TUBE SUBMUNITION DISPENSER

[75] Inventor: Lawrence C. Mitchell, Jr., Bellevue, Wash.

[73] Assignee: The Boeing Company, Seattle, Wash.

[21] Appl. No.: 248,674

[22] Filed: Mar. 30, 1981

[51] Int. Cl.[3] ..... F42B 13/50

[52] U.S. Cl. ..... 102/489

[58] Field of Search ..... 102/383, 393, 394, 480, 102/494, 439, 505, 338, 340, 345, 351, 352, 357, 360

[56] References Cited

U.S. PATENT DOCUMENTS

| | | | |
|---|---|---|---|
| 372,753 | 11/1887 | Hurst . | |
| 1,129,696 | 2/1915 | Lobenat . | |
| 1,284,777 | 11/1918 | Rinehart . | |
| 1,303,877 | 5/1919 | Francois . | |
| 1,343,036 | 6/1920 | Cook . | |
| 1,350,339 | 8/1920 | Richards . | |
| 1,417,299 | 5/1922 | Cahill . | |
| 2,359,192 | 9/1944 | Beblo . | |
| 2,376,227 | 5/1945 | Brown . | |
| 2,379,257 | 6/1945 | Scott . | |
| 2,419,854 | 4/1947 | Peterson . | |
| 2,428,744 | 10/1947 | Sonnenschein . | |
| 2,925,965 | 2/1960 | Pierce . | |
| 3,103,889 | 9/1963 | Keeney, Sr. . | |
| 3,489,088 | 1/1970 | Von Ballmoos et al. . | |
| 3,899,975 | 8/1975 | Lawrence . | |
| 4,172,407 | 10/1979 | Wentink | 102/394 |
| 4,233,882 | 11/1980 | Eichweber | 102/480 |
| 4,372,216 | 2/1983 | Pinson et al. | 102/393 |

FOREIGN PATENT DOCUMENTS

| | | | |
|---|---|---|---|
| 2909326 | 9/1980 | Fed. Rep. of Germany | 102/480 |

OTHER PUBLICATIONS

"Aviation Week & Space Technology", Dec. 15, 1980, p. 100.

*Primary Examiner*—Charles T. Jordan

*Attorney, Agent, or Firm*—Schwartz, Jeffery, Schwaab, Mack, Blumenthal & Koch

[57] ABSTRACT

A stacked tube submunitions dispenser (11) comprises an array (15) of nested launch tube clusters (23) disposed within a dispenser envelope (19). Each cluster (23) includes a plurality of fixed launch tubes (17) uniformly arranged around the central axis of the envelope (19) so that the angle between adjacent launch tubes (17) of a cluster (23) is substantially equal. The launch tubes (17) extend rearwardly and outwardly from the central axis from the envelope (19) in a substantially conical configuration. Each launch tube (17) includes a guide surface (33) for supporting a submunition (35) in a stowed position, a guide surface (37) for guiding the submunition during a dispensing event; and means for dispensing (39, 41) the submunition. Additionally, each launch tube includes a jettisonable aerodynamic cover (21) which provides the envelope (19) with a clean aerodynamic configuration. An additional volume (43) is available rearward of the submunition (35) but inside the envelope (19).

10 Claims, 5 Drawing Figures

STACKED TUBE SUBMUNITION DISPENSER

BACKGROUND OF THE INVENTION

1. Field of the Invention

This invention generally relates to an arrangement for dispensing submunitions from a tactical field or air launched carrier missile (CM) and more particularly to a submunitions dispenser having an array of stacked launch tube clusters disposed within a dispenser envelope.

2. Description of the Prior Art

Present missile technology and field use requirements have led to the development of guided projectiles for deploying free-flight terminally guided submunitions (TGSM) in the proximity of a target area which seek out hostile military targets. when designing a dispensing system for TGSM's, range capabilities and carrier missile stability during deployment must be maximized for best overall weapon lethality.

Typically, submunition-dispensing systems utilize gas-operated ejection systems for simultaneously dispensing a plurality of submunitions. The dispensing event begins with, or is coincident with, the separation of outer aerodynamic skins from the warhead section of the carrier missile followed by the deployment of multiple (6 or 8) submunitions at a time. Without the outer dynamic skins, the carrier missile experiences instability necessitating high g forces acting on the submunitions (TGSM's) to assure proper dispense. This leads to an inflexible, all or nothing, dispensing scenario. Further, when TGSM dispensers utilize complex erector/retractor launch tube mechanisms dispense reliability suffers thereby influencing the overall lethality of a fielded system.

The prior art, such as U.S. Pat. No. 372,753, discloses a shell having a plurality of radial charge-chambers containing projectiles adapted to be discharged laterally from the shell in the vicinity of an intended target. U.S. Pat. No. 1,350,339 teaches the use of covers to close the face of a bullet chamber. Additionally, an arrangement for radially discharging a plurality of subprojectiles at intervals during the flight of a main projectile is disclosed in U.S. Pat. No. 1,129,696. Further, a dispensing arrangement comprising a plurality of barrels arranged in direct side-to-side contact with one another for simultaneously discharging a projectile from each barrel is disclosed by U.S. Pat. No. 2,376,227.

DISCLOSURE OF THE INVENTION

A stacked tube submunition dispenser comprising an array of stacked launch tube clusters disposed within a dispenser envelope. Each cluster includes a plurality of uniformly arranged launch tubes which extend rearwardly and outwardly from the central axis of the envelope in a substantially conical configuration. The launch tube includes a support surface for supporting the TGSM in a stowed position, a guide surface for guiding the TGSM during deployment and means for deploying the TGSM. Each tube includes an individual jettisonable aerodynamic cover providing the dispenser envelope with a minimum drag configuration. Further, an additinal tube volume exists to the rear of the stowed TGSM, but inside the dispenser envelope for supplemental equipment.

The dispensing arrangement of the present invention provides the advantages of launch tubes which are fixed in place at an angle compatible with submunition ejection, whether the carrier missile is either at subsonic or supersonic speeds, so that the submunition ejection is substantially independent of mechanical linkages and moving parts. The nested cluster arrangement permits a high packing factor of the fixed launch tubes within the dispenser envelope.

The stacked design assures good clearance of the carrier missile tail surfaces during deployment of the submunitions as well as a compact arrangement providing excess space within the dispenser ogival envelope for carrier missile guidance, communication, and power equipment mounting as well as for servicing and installation of ordnance.

Further, guided surfaces for the submunition during ejection extend well beyond its stowed position, so that the dispenser fully supports a TGSM to resist air loads until it has completely exited the launch tube. Since the carrier missile/dispenser configuration can be designed with a high degree of inherent stability during the deployment sequence, exit velocity requirements for the TGSM's are considerably lower since the submunitions do not have to be ejected in accordance with a specific mechanical event sequence.

Since each stacked launch tube is provided with an individual, jettisonable cover, the TGSM's can be deployed in pairs, pair multiples, clusters, or volleys at a time. Therefore, a flexible dispensing scenario can be fashioned to battleground needs.

Additionally, the time sequencing for jettisoning launch tube covers provides a simple and effective means of carrier missile control for trajectory shaping and dispensing parameters at various ranges. Also, the jettisoning of the tube covers over the intended target area can be designed such that an explosive stowed within the launch tube volume behind the TGSM and attached to or pulled free by the cover jettisoning provides a random, secondary kill capability.

BRIEF DESCRIPTION OF THE DRAWINGS

The details of the present invention will be described in connection with the accompanying figures of drawing.

BEST MODE FOR CARRYING OUT THE INVENTION

Figure 1:
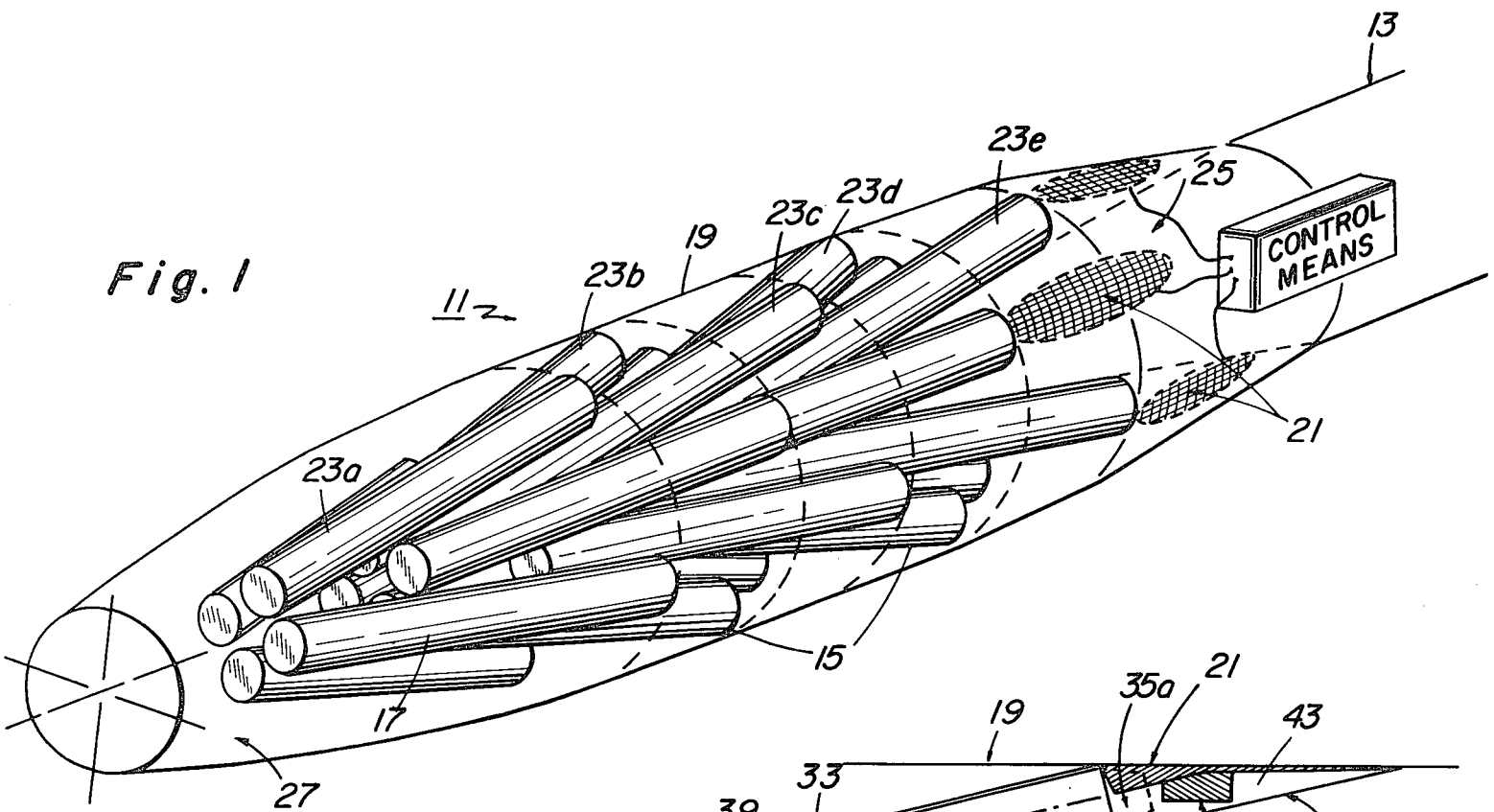
FIG. 1 is a prospective fragmentary view of the stacked tube submunition dispenser of the present invention.

Referring to FIG. 1, a stacked tube submunition dispenser 11 is illustrated in a hammerheaded configuration on a carrier missile 13. Equally effective would be an arrangement of the dispenser mounted upon a missile of larger cross-section without the hammerhead configuration. The dispenser 11 comprises an array 15 of stacked launch tubes 17 disposed within a dispenser housing or envelope 19. Each tube 17 similarly interfaces at the dispenser housing surface with a jettisonable cover 21 providing the envelope 19 with a streamline aerodynamically acceptable configuration. The jettisoning of each cover 21 can be individually controlled by a control means as illustrated in FIG. 1. The control means typically takes the form of a microprocessor linked to the guidance system of the carrier missile 13. The operation of the control means will be more fully discussed hereinafter with respect to the deployment sequence.

The array 15 of stacked launch tubes comprises a plurality of tube clusters 23*a*, 23*b*, 23*c*, 23*d* and 23*e*. It is understood by one skilled in the art that the number of launch-tube clusters 23 or the number of launch tubes that make up one cluster can be varied in accordance with the present invention. Each launch tube cluster 23 comprises a plurality of fixed launch tubes 17 extending rearwardly and outwardly from the central axis of the envelope 19 in a substantially conical configuration. The series of launch tube clusters 23*a*–23*e* are nested by staggering each cluster 23 about the central axis of the envelope 19 to fit the launch tubes of a cluster within the space between adjacent tubes of a previous cluster. This arrangement provides a compact array 15 of launch tubes 17 so that ample space exists within the dispenser envelope 19 for a rear-equipment compartment 25 as well as an additional nose section equipment compartment 27 to house antennas, guidance equipment and the like.

Figure 2A:
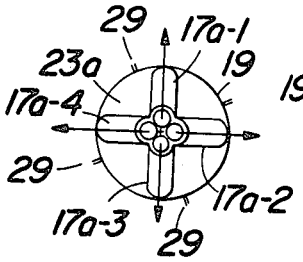
FIGS. 2-A and 2-B are front cut-away views illustrating the position of tube clusters of the dispenser.
Figure 2B:
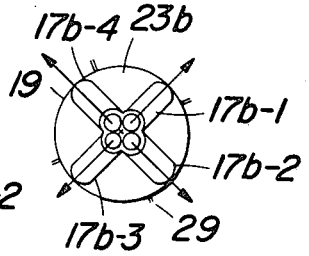

The nested arrangement of the tube clusters 23 is best illustrated by reference to FIGS. 2A and 2B which illustrates a tube dispenser arrangement wherein each cluster 23 includes a plurality of launch tubes 17 which are uniformly arranged around the central axis of the dispenser envelope 19. The angle between adjacent launch tubes is substantially equal. It is understood by one skilled in the art that the number of launch tubes 17 of each cluster 23 may be varied while preferably maintaining the angle between adjacent launch tubes 17 substantially equal. Further, the launch tubes 17 of each cluster 23 extend rearwardly and outwardly from the central axis of the dispenser envelope 19 at substantially the same angle.

By staggering each cluster about the central axis of envelope 19 so that the launch tubes of a cluster fit within the space between the launch tubes of a previous cluster, the clusters 23*a*–23*e* form a nested or stacked array 15. The first cluster 23*a*, shown in FIG. 2A, is positioned about the central axis of the envelope 19 to assure good clearance of the carrier missile tail surfaces 29 (FIG. 4) of the carrier missile 13 during the deployment of each TGSM of each tube 17 of the array 15. The second cluster 23*b*, shown in FIG. 2B, is positioned behind the first cluster 23*a* and rotated about the central axis of the envelope 19 through an angle equal to one-half the angle between adjacent tubes of a single cluster. Proper design will assure that the cluster 23*b* will also not interfere with the carrier missile tail surfaces. This positions tube 17*b*-1 of the second cluster 23*b* mid-way between the adjacent tubes 17*a*-1 and 17*a*-2 of the first cluster 23*a*. Tube 17*b*-2 of the second cluster 23*b* is positioned mid-way between the adjacent tubes 17*a*-2 and 17*a*-3 of the first cluster 23*a*. Tube 17*b*-3 of the second cluster 23*b* is positioned mid-way between the adjacent tubes 17*a*-3 and 17*a*-4 of the first cluster 23*a*, and the tube 17*b*-4 of the second cluster 23*b* is positioned mid-way between the adjacent tubes 17*a*-4 and 17*a*-1 of the first cluster 23*a*. The subsequent cluster 23*c*–23*e* are staggered in a similar fashion about the central axis of the envelope 19 to form a stacked or nested array 15 of launch tubes 17.

Figure 3:
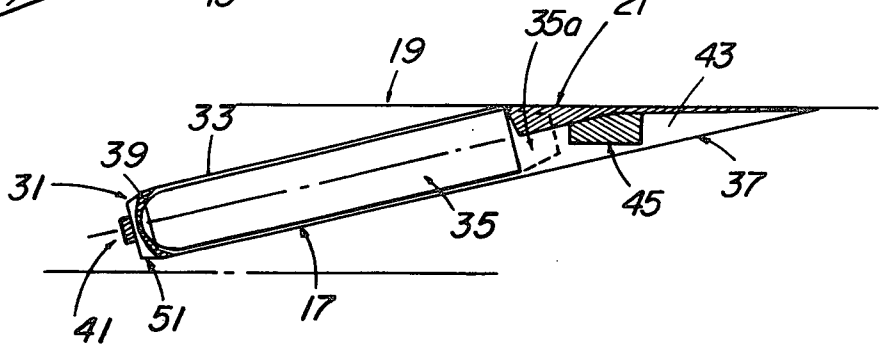
FIG. 3 is a side-sectional view of a launch tube.

FIG. 3 illustrates a typical launch tube 17 having a support surface 33 for supporting a TGSM 35 in the stowed position, a guide surface 37 for guiding the TGSM 35 during deployment, a sabot or piston-like device 39 for supporting the nose of the TGSM 35 during deployment and an ejector gas generating charge 41 to force the TGSM 35 from the tube 17. Since the guide surface 37 extends well beyond the stowed TGSM position, an additional volume 43 is provided at the outermost portion of the launch tubes 17, but inside the dispenser envelope 19. The additional volume 43 may be utilized to accommodate alternate, tapered end designs of the submunition itself as indicated generally at 35*a*. Such designs may permit inclusion of decelerators or other equipment within the TGSM. The additional volume 43 may alternately or additionally be used to house a secondary explosive device 45, such as an antipersonnel bomb, adapted to detonate upon ground impact. Alternatively, the additional volume 43 is available for housing additional TGSM internal equipment inside the dispenser envelope 19.

The forward end of each launch tube 17 is tapered to minimize the full diameter tube length. By tapering the forward end of each launch tube 17 at 51, the packaging density of the tube clusters 23 is increased to minimize the overall length and diameter of the array 15.

In operation, the carrier missile 13 is launched to transport the TGSM's within range of a target area. Equipment on board the carrier missile 13 designates the dispensing scenario pairs or pair multiples of submunitions to be released. Typically, submunitions are released in pairs, pair multiples or clusters at a time.

The dispensing event begins when the guidance system indicates the carrier missile 13 is correctly positioned with respect to a target area. The dispenser control equipment acts as the interface between the carrier missile guidance and the dispenser. It initiates the dispense sequence in response to the carrier missile guidance system by sequencing the jettisoning of appropriate covers 21 to expose the launch tubes 17 intended for use. The means for jettisoning the covers 21 is typically a pyrotechnic device activated in response to a signal from the control means. The pyrotechnic device may take the form of an embedded zipper-strip pyrotechnic device, an explosive bolt, or a pin puller arrangement which mechanically releases the cover 21 upon detonation of the pyrotechnic device.

The removal of the covers 21 increases the drag on the envelope 19, and early release could be used to reduce the speed at which the TGSM's are dispensed. The timing of the jettisoning of the covers 21 provides a simple and effective means of missile draw control for trajectory shaping and control over the dispensing conditions at various ranges.

The secondary explosive device 45 can be attached to the aerodynamic cover 21 as illustrated in FIG. 3 so as to be deployed with the cover as it is jettisoned. Alternatively, the explosive device 45 can be provided with an individual deployment (not shown) for individually dispensing the device 45 under the control of the control means illustrated in FIG. 1. Further, the device 45 can be deployed by the TGSM movement as it is dispensed from the launch tube 17.

Once the launch tubes have been exposed, the dispensing of the TGSM's begins with the activation of the ejector charge 41. The ejector charge 41 may take the form of a pyrotechnic device adapted to produce a large volume of gas at the lower end of the launch tubes 17. The forward tapered launch tube section 51 may be designed to provide any required separation distance between the sabot 39 and the ejector charge 41. As the ejector charge 41 is activated, the sabot 39 maintains the pressure at the lower end of the tube 17 to force the TGSM 35 in a rearward direction. Since the guide surfaces 37 extend well beyond the stowed TGSM position, the guide surfaces 37 resist large turning forces imposed upon the TGSM 35 as it enters the air flow field around the envelope 19 during deployment. In this manner, the TGSM 35 is fully supported by the launch tube 17 to resist air loads until completely deployed from the launch tube 17. This configuration is fully stable during all phases of the dispensing event.

Figure 4:
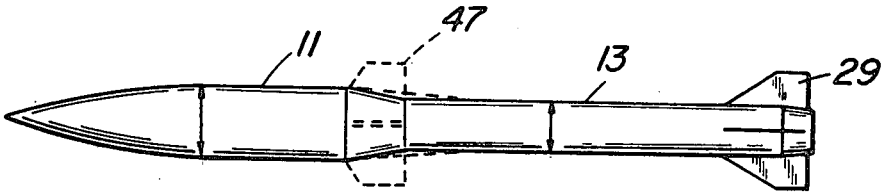
FIG. 4 is a side-view of the present invention hammerhead on a carrier missile.

FIG. 4 illustrates the dispenser 11 hammerheaded on a carrier missile 13. The dispenser envelope 19 can optionally include wings 47 to increase lift and therefore, the range capabilities of the carrier missile.

While the invention has been particularly shown and described with reference to the preferred embodiments thereof, it is understood by those skilled in the art that various changes in form and detail may be made wherein without departing from the scope of the invention. For example, each launch tube 17 may contain a plurality of smaller submunitions.

The embodiments of the invention which an exclusive property right or privilege is claimed, is defined by the following claims:

I claim:

1. A stacked tube submunition dispenser comprising:

(a) an elongated dispenser housing having a forward and rear section and a central axis;

(b) a plurality of launch tube clusters disposed within said housing;

(c) each cluster having a plurality of fixed launch tubes arranged around the central axis of said housing and, for each cluster, said launch tubes having forward ends lying in a forward common plane, through said housing, and rearward ends lying in a rearward common plane, (d) the launch tubes of adjacent clusters offset azimuthally from each other;

(e) said launch tubes of each cluster extending rearwardly and outwardly from the central axis of said housing in a substantially conical configuration and having a symmetry axis coincident with the central axis of said housing; and (f) each cluster offset longitudinally along the housing central axis with respect to adjacent clusters and the forward common plane of at least one of said clusters lying between the forward and rearward common planes of an adjacent cluster to thereby form a fixed, nested configuration.

2. The dispenser as recited in claim 1, wherein each launch tube comprises means for supporting a submunition in a stowed position, means for guiding the submunition during dispensing thereof, and means for dispensing the submunition.

3. The dispenser as recited in claim 1, wherein each launch tube includes an individually jettisonable aerodynamic cover.

4. The dispenser as recited in claim 1, wherein each launch tube includes an additional volume rearward of the submunition, but inside said housing.

5. The dispenser as recited in claim 1, wherein said housing includes wings for increasing lift.

6. The dispenser as recited in claim 4, wherein said additional volume stores a secondary explosive device.

7. The dispenser as recited in claim 1, wherein each launch tube includes a tapered forward end for increasing the packing density of said array.

8. The dispenser as recited in claim 1, wherein the launch tubes of each cluster are arranged at substantially the same inclination angle relative to said central axis.

9. A dispenser as recited in claim 3 further comprising control means for jettisoning said covers in an individual manner.

10. A stacked tube submunition dispenser comprising:

(a) an elongated dispenser housing having a forward and rear section and a central axis;

(b) a plurality of launch tube clusters disposed within said housing;

(c) each cluster having a plurality of fixed launch tubes arranged around the central axis and, for each cluster, said launch tubes having forward ends lying in a forward common plane, through said housing, and rearward ends lying in a rearward common plane, (d) the launch tubes of adjacent clusters offset azimuthally from each other;

(e) said launch tubes of each cluster extending rearwardly and outwardly from the central axis of said housing in a substantially conical configuration and having a symmetry axis coincident with the central axis of said housing;

(f) each launch tube having a portion thereof extending beyond the submunition which is adapted to be enclosed therein, said portion having a surface for guiding the submunition during dispersing thereof, and (g) each cluster offset longitudinally along the housing central axis with respect to adjacent clusters and the forward common plane of at least one of said clusters lying between the forward and rearward common planes of an adjacent cluster to thereby form a fixed, nested configuration.

* * * * *